United States Patent [19]

Reichert et al.

[11] Patent Number: 4,639,193

[45] Date of Patent: Jan. 27, 1987

[54] FAN WHEEL FOR RADIAL FAN

[75] Inventors: Gerhard Reichert, Coburg; Friedrich Riedel, Redwitz, both of Fed. Rep. of Germany

[73] Assignee: Siemens Aktiengesellschaft, Munich, Fed. Rep. of Germany

[21] Appl. No.: 782,399

[22] Filed: Oct. 1, 1985

[30] Foreign Application Priority Data

Nov. 9, 1984 [DE] Fed. Rep. of Germany ..... 3441077

[51] Int. Cl.[4] ..... F04D 29/28

[52] U.S. Cl. ..... 416/184; 416/134 R; 416/188; 416/241 A

[58] Field of Search ..... 416/179–188, 416/190, 500, 170 R, 93 R, 93 A, 134 R, 135, 133; 415/213 R, 119, 122 R; 464/160, 84, 100, 101

[56] References Cited

U.S. PATENT DOCUMENTS

| | | | |
|---|---|---|---|
| 795,938 | 8/1905 | Seymour, Jr. | 416/181 |
| 1,827,770 | 10/1931 | Suter . | |
| 2,047,501 | 7/1936 | Wettstein . | |
| 2,212,555 | 8/1940 | Stevens, Jr. | 416/188 |
| 2,442,441 | 6/1948 | Shellberg | 416/181 |
| 3,846,045 | 11/1974 | Mincuzzi | 415/119 |
| 4,150,919 | 4/1979 | Matucheski | 416/181 |
| 4,470,753 | 9/1984 | Witzel | 416/184 |

FOREIGN PATENT DOCUMENTS

| | | | |
|---|---|---|---|
| 1453708 | 1/1969 | Fed. Rep. of Germany . | |
| 2431049 | 6/1979 | France . | |
| 40808 | 3/1977 | Japan | 416/185 |
| 117756 | 8/1918 | United Kingdom . | |
| 2060069 | 9/1980 | United Kingdom . | |

*Primary Examiner*—Everette A. Powell, Jr.
*Attorney, Agent, or Firm*—Kenyon & Kenyon

[57] ABSTRACT

A single-piece plastic fan wheel for a radial fan comprises a hub, a blade ring having fan blades and an intermediate piece interconnecting the hub and the blade ring. The hub comprises an inner hub ring attachable to the drive shaft of a motor and an outer hub ring connected to the inner hub ring by a plurality of axially and radially extending resilient strips which serve to damp tangential vibrations emanating from the motor owing to pulsations in the torque output thereof.

10 Claims, 5 Drawing Figures

FAN WHEEL FOR RADIAL FAN

BACKGROUND OF THE INVENTION

This invention relates to a fan wheel of a radial fan assembly. More particularly, this invention relates to a single-piece fan wheel for a radial fan in the heating, ventilating and air conditioning system of an automotive vehicle.

In heating, ventilating and air conditioning systems of motor vehicles, the fan wheels of radial fans are driven by small d-c motors. The electric motors have permanent magnets in the stators, while the windings in the rotors are accommodated in open slots. For each revolution of the rotor, the magnitude of the torque delivered pulsates in accordance with the number of slots or a multiple thereof. Accordingly, a slotting frequency or oscillation results which is equal to the number of revolutions per minute times the number of slots in the rotor.

The effect of the torque pulsations on a radial fan with a rigidly mounted fan wheel is to give the wheel a slight radial or tangential relative motion in the rhythm of the slotting frequency. If the fan wheel has in the radial or tangential direction a resonance area, e.g., the fan blades in a radial blower, the slotting frequency becomes audible as a disturbance at a certain rotation speed. The resonance excitation can be minimized by such measures as setting the slots at an angle in the motor. However, the effect of the pulsations in torque cannot be entirely eliminated by such measures.

It has been attempted to place the operating points of radial fans outside of the resonance ranges. With an increasing trend toward regulation, it is necessary, however, to cover the entire range of speed without the production of a hum frequency. To achieve this goal, thin curved spokes have been used as damping elements between the hub and the blade ring of a radial fan, as described in U.S. Pat. No. 4,470,753. The spokes are provided in an intermediate piece which connects the outer surface of the hub to the blade ring. Radial and axial distortions in the spokes due to the aging of the plastic or to centrifugal force results disadvantageously in an increase in the imbalance and, therefore, in an aggravation of the sounds arising from the pulsations in torque.

An object of the present invention is to provide an improved radial fan wheel of the above-described type.

Another object of the present invention is to provide such a fan wheel in which a sound-damping effect continues even after extended periods of operation.

SUMMARY OF THE INVENTION

A radial fan wheel in accordance with the present invention comprises a hub including an inner hub ring and an outer hub ring coaxial with the inner hub ring, the inner hub ring being fastenable to a rotary output shaft of a drive motor. The hub further includes a resilient component connecting the inner hub ring to the outer hub ring. The resilient component serves the function of damping pulsations in angular or tangential velocity or torque transmitted from the drive motor. A blade ring coaxial with the hub and carrying a multiplicity of circumferentially equispaced fan blades is connected to the hub by an annular intermediate section.

Preferably, the fan wheel is an integral plastic piece and is used in the heating, ventilating and air conditioning system of an automotive vehicle. The intermediate section can assume one of two alternative embodiments:

it can either be a solid piece or is provided with a plurality of circumferentially spaced apertures and takes the form of a plurality of spokes interconnecting the hub and the blade ring.

In accordance with a particular feature of the present invention, the resilient component for damping the pulsations or oscillations in torque or angular velocity is a plurality of resilient strips or straps interconnecting the inner hub ring and the outer hub ring.

In accordance with additional, more particular, features of the present invention, the resilient strips have axial lengths smaller than the axial length of the hub and are each axially staggered with respect to two adjacent resilient strips.

Pursuant to yet another feature of the present invention, at least one of the hub rings is provided with at least one driver stop associated with one of the resilient strips.

In a radial fan having a fan wheel in accordance with the invention, tangential motor excitations, i.e., pulsations in torque, are not transmitted to the blower blades. Consequently, the motion of the fan wheel in the tangential direction, as well as in the axial direction, is stable. Any centrifugal forces which might arise cannot cause an increase in imbalance.

It has been observed that in radial motor vehicle blowers, tangential resonance frequencies of the fan blade are between 200 and 600 Hz. In order to achieve effective damping, the tangential resonance frequency of the wheel must be several times smaller than 200 Hz, i.e., the interposed damping spring must be tuned low with respect to the mass of the wheel or have a soft or flexible action.

In a plastic fan wheel in accordance with the present invention, the thickness of the damping strips interconnecting the inner and outer hub rings cannot be less than a minimum value, owing to limitations in molding technology. If the low frequency tuning requires a spring with softer action, this end can be achieved by decreasing the axial dimensions of the strips. In order to obtain a wheel which nevertheless has stable operating characteristics in the radial and axial directions, the connecting strips in the hub are axially offset or staggered with respect to one another.

In accordance with the present invention, the preferred standard for the intermediate section interconnecting the fan hub with the blade ring is a solid, i.e., single-piece, low-turbulance wheel disc. If, in a double-flow fan wheel design, the intake cross-section on the motor side of the radial fan is narrowed too much by the motor, the intake cross-section for the motor side can be adapted by providing cutouts in the intermediate section for the blade ring.

The driver stop in accordance with the present invention serves as a twist stop for high torques in startblocking shocks, i.e., serves to prevent the resilient strips from bending beyond predetermined limits (e.g., their elastic limits) during transmission of high torques from the fan motor.

A fan wheel in accordance with the present invention is not subject to the unilateral aging distortions arising from moisture and temperature variations which affect long, bent individual spring spokes of prior designs. Moreover, in the case that the intermediate section between the outer hub ring and the blade ring is a solid piece of material, tangential vibrations are more effectively damped owing to the accumulation of mass between the outer hub ring and the blade ring.

DETAILED DESCRIPTION

Figure 2:
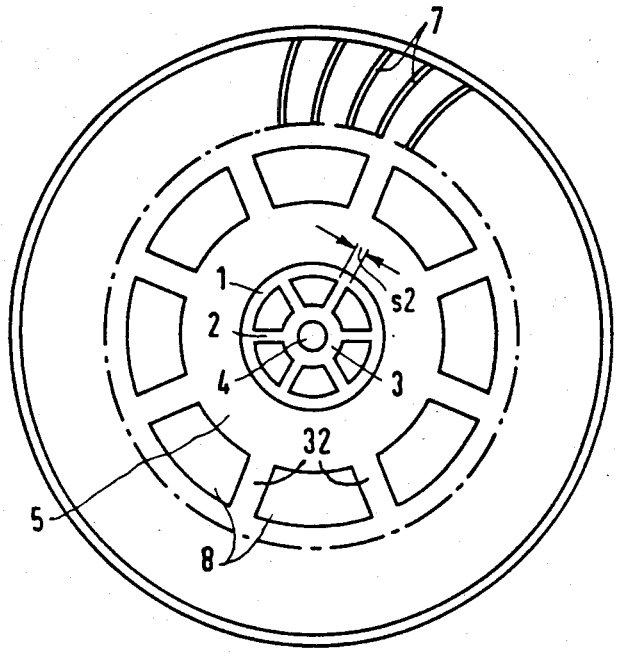
FIG. 2 is a top view of the fan wheel of FIG. 1.
Figure 1:
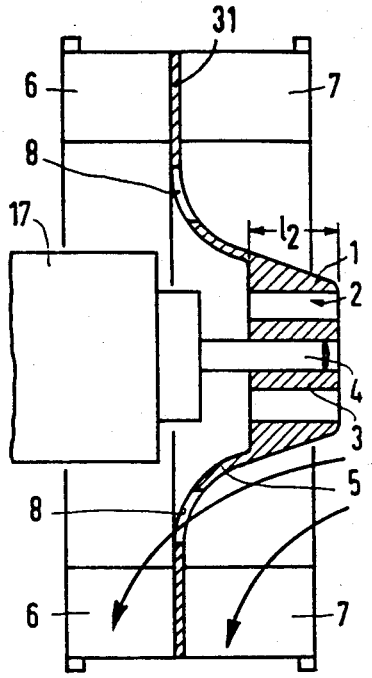
FIG. 1 is a longitudinal cross-sectional view of a fan wheel in accordance with the present invention.

As illustrated in FIGS. 1 and 2, a blower or fan wheel in accordance with the invention comprises an inner hub ring or sleeve 3 and an outer hub ring or sleeve 1 coaxial therewith. Hub rings 1 and 3 are connected to one another by a plurality of axially and radially extending resilient strips or straps 2 which are angularly equispaced from one another. The fan wheel further includes a blade ring 31 to which are attached a multiplicity of angularly equispaced rearward blades 6 and another multiplicity of angularly equispaced forward blades 7. Blade ring 31 may be viewed as an extension of an intermediate piece or section 5 connected at an inner side to an outer surface of outer hub ring 1 and connected at an outer side to blade ring 31.

The fan wheel illustrated in FIGS. 1 and 2 is preferably a single piece of injection molded plastic. Owing to the division of the fan blades by the blade ring 31 into forward and rearward blades 7 and 6, the fan wheel takes the form of a double-flow wheel.

Inner hub ring 3 is attachable to the output drive shaft 4 of a drive motor 17. In order to control the amount of cooling air flowing past drive motor 17, intermediate section 5 may be provided with a plurality of angularly equispaced cutouts or apertures 8, whereby the intermediate section may take the form of a plurality of angularly equispaced spokes 32 interconnecting outer hub ring 1 and blade ring 31.

Because of restrictions imposed by current injection molding technology, the thickness $s_2$ of resilient connector strips 2 must be greater than a minimum value. If the frequency tunning of a particular application requires a softer spring action, this result can be achieved by shortening the length $1_2$ of connector strips 2.

Figure 3:
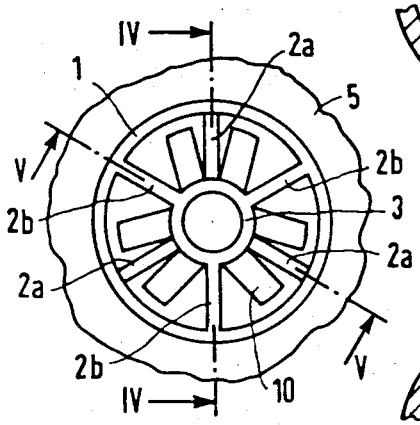
FIG. 3 is a partial top view of another fan wheel in accordance with the present invention, showing a driver stop.
Figure 4:
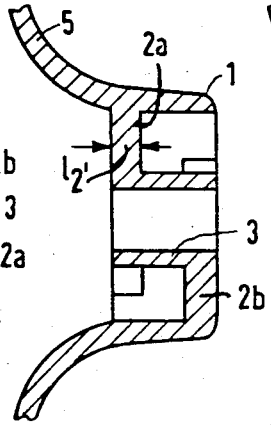
FIG. 4 is a partial longitudinal cross-sectional view taken along line IV—IV in FIG. 3.
Figure 5:
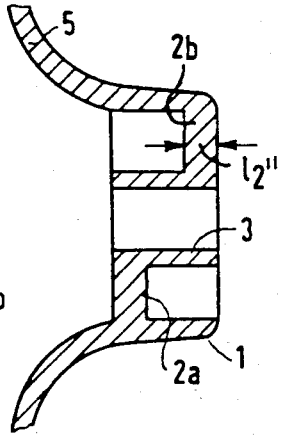
FIG. 5 is a partial longitudinal cross-sectional view, similar to FIG. 4, taken along line V—V in FIG. 3.

As illustrated in FIGS. 3, 4 and 5, in a fan wheel with a soft spring action for damping tangential vibrations or pulsations in accordance with the present invention, inner hub ring 3 is connected to outer hub ring 1 by a multiplicity of rearwardly disposed connector strips 2*a* having an axial dimension or length $1_2'$, which strips angularly alternate with a multiplicity of forwardly disposed connector strips 2*b* having an axial length $1_2''$. Accordingly, each resilient connector strip 2*a* or 2*b* is axially staggered with respect to the adjacent two connector strips 2*b* or 2*a*. Preferably, lengths $1_2'$ and $1_2''$ are equal.

The fan wheel illustrated FIGS. 3, 4 and 5 operates stably in both the radial and axial directions. In addition, the fan wheel may be provided with a driver stop in the form of a radial projection 10 fixed to inner hub ring 3 (or outer hub ring 1), projection 10 serving as a twist stop for high torques in start-blocking shocks, i.e., for protecting strips 2*a* and 2*b* from bending beyond their elastic limits during the transmission of high torques from fan motor 17.

Although the invention has been described in terms of particular embodiments and applications, one of ordinary skill in the art, in light of this teaching can generate additional embodiments and modifications without departing from the spirit of or exceeding the scope of the claimed invention. Accordingly, it is to be understood that the descriptions and illustrations herein are proffered to facilitate comprehension of the invention and should not be construed to limit the scope thereof.

What is claimed is:

1. A radial fan wheel comprising:

a hub having an axial length and including an inner hub ring and an outer hub ring, said outer hub ring being coaxial with said inner hub ring, said inner hub ring being fastenable to a rotary output shaft of a drive motor;

resilient means disposed between said inner hub ring and said outer hub ring for damping pulsations in torque transmitted from said drive motor, said resilient means including a plurality of planar resilient strips connecting said inner hub ring to said outer hub ring, said resilient strips extending in radial planes and having axial lengths smaller than the axial length of said hub, each of said resilient strips being axially staggered with respect to two of said resilient strips adjacent thereto;

a blade ring coaxial with said hub;

a multiplicity of fan blades fixed to said blade ring, said blades being circumferentially equispaced about said blade ring; and an annular intermediate section connected at an inner periphery to said hub and at an outer periphery to said blade ring.

2. A radial fan wheel according to claim 1 wherein the fan wheel is an integral plastic piece.

3. A radial fan wheel according to claim 1 wherein said intermediate section is a solid piece and is connected at an inner side to an outer surface of said outer hub ring and an an outer side to said blade ring.

4. A radial fan wheel according to claim 1 wherein said intermediate section is provided with a plurality of circumferentially spaced apertures and takes the form of a plurality of spokes interconnecting said hub and said blade ring.

5. A radial fan wheel according to claim 1 wherein one of said outer hub ring and said inner hub ring is provided with at least one driver stop associated with one of said resilient strips.

6. In a one-piece plastic fan wheel for a radial fan, especially for use in the heating, ventilating and air conditioning system of an automotive vehicle, said fan wheel having a hub attachable to a drive shaft of a drive motor and further having a blade ring connected to the hub via an intermediate section, the improvement wherein said hub includes an inner hub ring and an outer hub ring, said outer hub ring being coaxial with said inner hub ring, said inner hub ring being fastenable to the shaft of the drive motor, said hub further including a plurality of resilient strips connecting the blade ring to said outer hub ring, said resilient strips extending in radial and longitudinal planes, said hub having an axial length and said resilient strips having axial lengths smaller than the axial length of said hub, each of said resilient strips being axially staggered with respect to two of said resilient strips adjacent thereto, the intermediate section connecting the blade ring to said outer hub ring.

7. The improvement according to claim 6 wherein one of said outer hub ring and said inner hub ring is provided with at least one driver stop associated with one of said resilient strips.

8. The improvement according to claim 6 wherein said intermediate section has cooling air cutouts provided between an outer surface of said outer hub ring and said blade ring.

9. A radial fan wheel formed of an integral piece of plastic, for use in the heating, ventilating and air conditioning system of an automotive vehicle, said fan wheel comprising:

a hub including an inner hub ring and an outer hub ring, said outer hub ring being coaxial with said inner hub ring, said inner hub ring being fastenable to a rotary output shaft of a drive motor, said hub further including a plurality of resilient strips connecting said inner hub ring to said outer hub ring, said resilient strips extending in radial and longitudinal planes, said hub having an axial length, said resilient strips having axial lengths smaller than the axial length of said hub, each of said resilient strips being axially staggered with respect to two of said resilient strips adjacent thereto;

a blade ring coaxial with said hub;

a multiplicity of fan blades fixed to said blade ring, said blades being circumferentially equispaced about said blade ring; and an annular intermediate section connected at an inner periphery to said hub and at an outer periphery to said blade ring, said intermediate section being provided with a plurality of circumferentially spaced apertures, thereby taking the form of a plurality of spokes interconnecting said hub and said blade ring.

10. A radial fan wheel according to claim 9 wherein one of said outer hub ring and said inner hub ring is provided with at least one driver stop associated with one of said resilient strips.

* * * * *